United States Patent [19]

Lederrey

[11] Patent Number: 4,459,038

[45] Date of Patent: Jul. 10, 1984

[54] PROTECTING DEVICE OF A DESCRIPTIVE INFORMATION APPEARING ON A WATCHCASE PIECE

[75] Inventor: Marc Lederrey, Le Landeron, Switzerland

[73] Assignee: Montres Rado S.A., Biel, Switzerland

[21] Appl. No.: 404,988

[22] Filed: Aug. 4, 1982

[51] Int. Cl.[3] ..... G04B 37/00

[52] U.S. Cl. ..... 368/276; 368/294

[58] Field of Search ..... 368/62, 82, 88, 223, 368/239, 276, 281, 285, 286, 294–296, 309, 318; 40/2 R, 334; 156/293, 298

[56] References Cited

U.S. PATENT DOCUMENTS 3,982,386 9/1976 Desaules ..... 368/318

4,122,662 10/1978 Visconti ..... 368/169 X

*Primary Examiner*—Vit W. Miska

*Attorney, Agent, or Firm*—Parkhurst & Oliff

[57] ABSTRACT

The protecting device comprises a transparent sapphire plate. The trade-mark of the watch and a digital indication are applied on the reverse side of that plate. These indications are applied by vaporization under vacuum. The digital indication is introduced in an index by the watch manufacturer and forms part of a code permitting the individualization of the watches produced and to identify them at all time. Said plate is indissolubly glued onto the sapphire glass of the watch so that said indications are sandwiched between these two pieces. The individualization of the product, that this protecting device permits, constitutes for the purchaser of the watch the guarantee that the indication designating the origin of the watch is genuine.

9 Claims, 17 Drawing Figures

Fig. 8
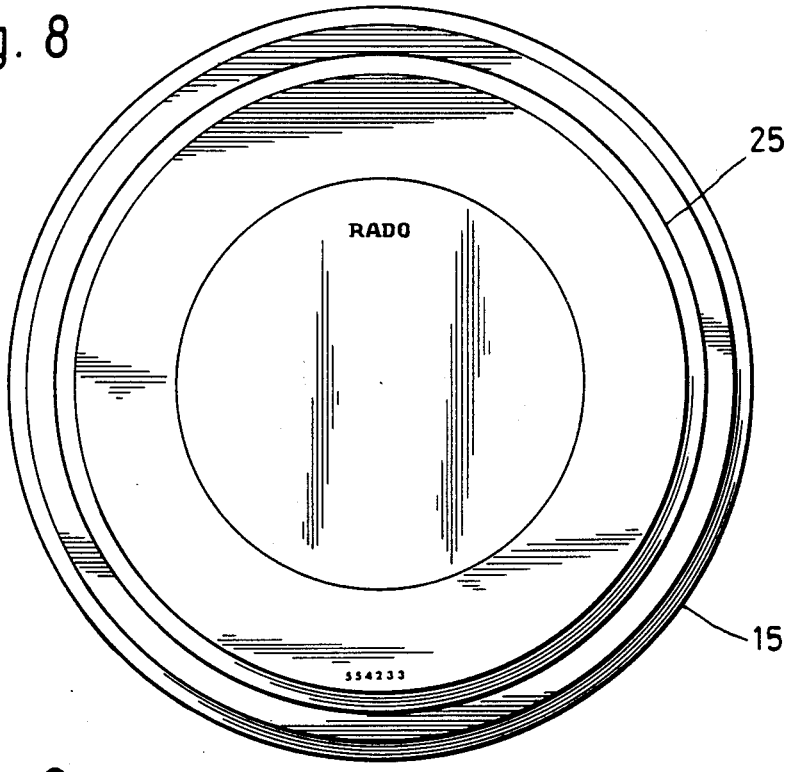
Fig. 9
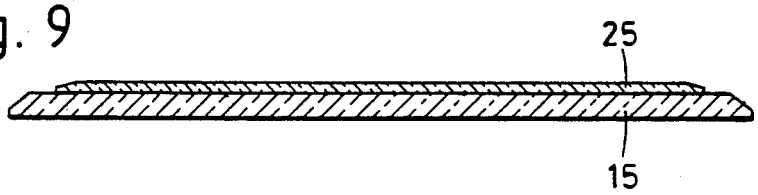
Fig. 10
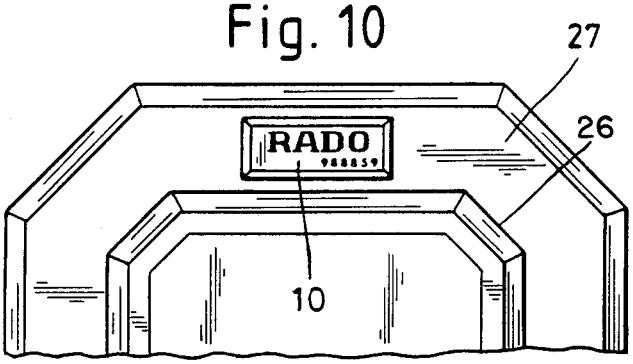
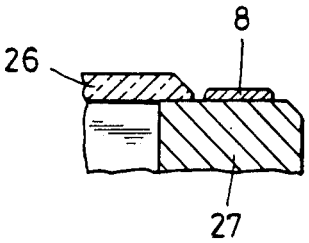
Fig. 11

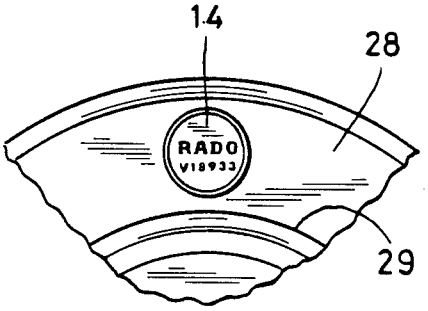
Fig. 12
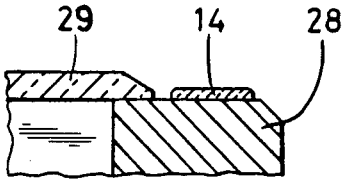
Fig. 13
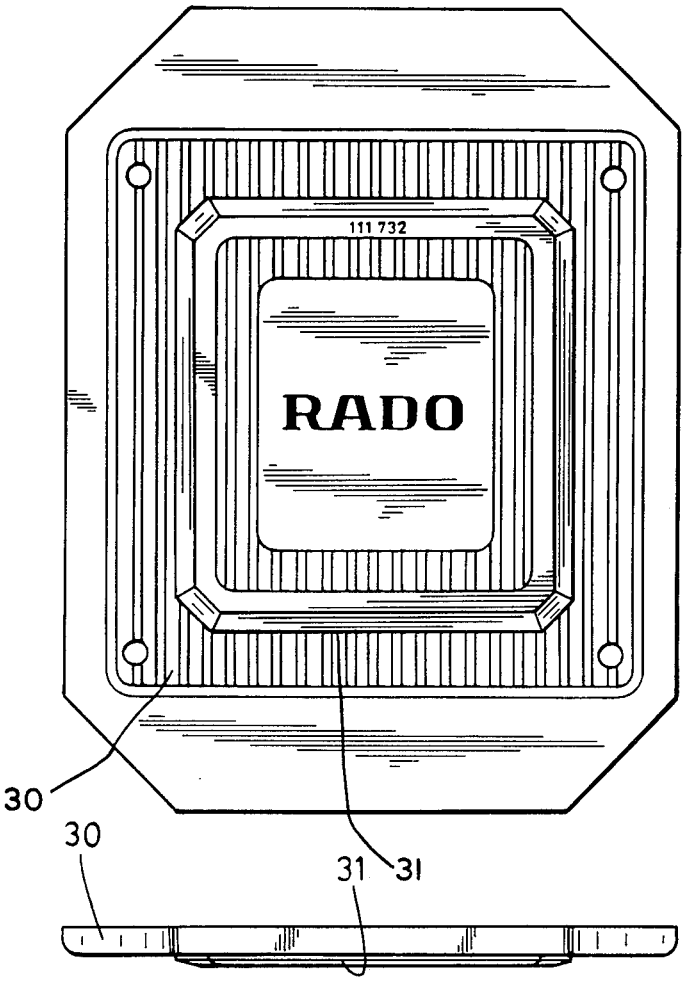
Fig. 14
Fig. 15

PROTECTING DEVICE OF A DESCRIPTIVE INFORMATION APPEARING ON A WATCHCASE PIECE

BACKGROUND OF THE INVENTION

1. Field of the Invention

This invention relates to the devices provided in the watches for protecting a descriptive information appearing on their casings and to which the watch manufacturer and his distributors are interested.

2. Description of the Prior Art

With the known watches provided with a device of the type contemplated here, the information which has been protected consisted of an advertisement which was printed on a sheet of paper and placed in a recess of the bottom of the watch casing and covered therein by means of a plate glass without mirror coating, which was set in said bottom (CH-A-No. 29,191).

Watches provided with a protecting device of that kind are obviously intended for tradesmen selling coffee for instance and who gratuitously distribute those watches to their best customers as gifts for publicity. The question was thereby to produce relatively cheap watches, the protecting device of which was manifestly not intended for warding the indications designating the watch origin from unfair copies.

Similar protecting devices have also been provided on the watch movements chiefly in order to facilitate their numbering. Those known devices comprise a plate glued within a recess of the baseplate of the watch movement. If that plate is transparent, the movement number is applied on its reverse side; if that plate is metallic, said number is applied on its observe side (U.S. Pat. No. 3,982,386).

The information given in that way is exclusively intended for the watch repairers. It permits them to identify the watches which they have to repair, if they need spare parts from the factory. Furthermore, the sapphire glass of a watch cannot be provided with a known device of that kind and the watchcase bottoms are not thick enough to provide them with a recess for the accomodation of the plate involved.

Protecting devices of the kind considered have in the art also been associated with table clocks for ensuring the protection of a publicity picture, of a postcard for instance, by gluing a thin celluloid sheet onto the picture (FR-A-No. 702,812). If such a protecting device is sufficient for a table clock, it would not support for a long time the stresses to which a watch carried every day is subjected.

All these known devices afford some protection to a descriptive information. The easiness of their manufacture render them however improper to protect the indications designating the origin of a watch to such an extent as to offer to its potential purchaser the guarantee to make the acquisition of a product truly issuing from the origin indicated on the watch.

Hitherto, the manufacturers of watches of top quality have usually indicated that origin by applying their trade-marks on the dial of their watches.

Now, the proliferation of the means of production of the pieces getting the watches up for sale, in particular of the dials, has just been followed by a steadily increasing production of shoddy watches masqueraded under the greatest trade-marks to the purchaser's detriment. It is true that the traditional mode of indicating the origin of a watch has facilitated the pirated production, since to be able to apply a trade-mark on a watch dial, there is no necessity to consider investing a big capital for whom already possesses the equipment required by the dial manufacture.

Thus, the sole summary test, with which the general public must be content, does no longer permit to ascertain that the indications of origin appearing on a watch are genuine.

SUMMARY OF THE INVENTION

The invention aims therefore to protect in a watch the indications designating its origin by means of a device which is out of reach of the bunglers for the cheap watches they illicitly put on the market.

The invention essentially considers to let appear at least a part of said indications through a transparent plate of scratchproof hard material, normally sapphire, which is indissolubly glued onto a piece being an integral part of the watch casing. Such plates are not products that can be found on the market. For whom is not seriously equiped for the production of fine watches, the manufacture of these plates would require an important investment. Ensuring their indissoble gluing to a piece of the watch casing without jeopardizing the transparency is also out of reach of those who try to sell their shoddy watches under well known trade-marks. The general public who reads indications designating the origin of a watch through such a plate accordingly has a serious guarantee that they are genuine.

Sandwiching a descriptive information between said plate and the support onto which it is glued offers a supplementary guarantee, because such an information must be applied very carefully in order that it will not suffer any alteration under the action of the indisoluble glues to be used.

The invention particularly enables the watch manufacturer to individualize his products by merely applying on the reverse side of said plates a coded information which additionally can be in sizes so small as to be no longer readable with the naked eye, thereby offering still a stronger guarantee of its genuineness.

The trade-mark of the watch manufacturer will obviously form part of the information appearing through said plate, which will preferably be glued onto the watch glass, but which can also be glued either on the bezel, if the latter is large enough or onto the bottom.

BRIEF DESCRIPTION OF THE DRAWINGS

Eight embodiments of the protecting device according to the invention are represented diagrammatically and by way of example in the accompanying drawings in which:

FIG. 6 is a plan view of a piece of the third embodiment, of which

FIG. 8 is a plan view of a piece of the fourth embodiment, of which

FIG. 9 is a diametrical sectional view;

FIG. 10 is a partial plan view of a piece of the fifth embodiment, of which

FIG. 11 is a partial cross-section;

FIG. 12, similar to FIG. 10, is a partial plan view of a piece of the sixth embodiment, of which FIG. 13 is a partial cross-section;

FIG. 14 is a view of the bottom side of the seventh embodiment;

FIG. 15 is an elevational view of a part of FIG. 14;

DESCRIPTION OF THE PREFERRED EMBODIMENTS

Figure 1:
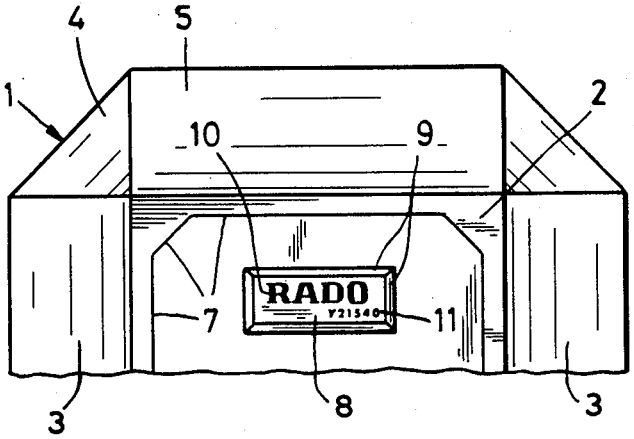
FIG. 1 is a partial plan view of a piece of the first embodiment.

The first four embodiments (FIGS. 1 through to 9) relate to watches in which the glass covers the whole metallic section of the watch casing which is disclosed in the European patent application No. 82810187.3, corresponding to my U.S. patent application Ser. No. 06/374689. The non-transparent ornamental elements, which constitute the casing face visible around the dial, thus form a unit with the glass, to which they are joined, and that unit is secured to the metallic section of the casing by means of screws inserted from the bottom side of the casing into tapped sockets integral with said unit and located under the ornamental elements of the glass, said screws simultaneously securing the bottom of the casing to its caseband.

Thus in the first embodiment (FIGS. 1 to 3) the sapphire glass 1 itself has the general shape of a rectangle. Its corners are truncated. Its plane upper face 2 is bevelled as shown at 3, 4, 5. The periphery of glass 1 is opacified by ornamental elements (not shown) permanently fixed to the lower plane face 6 of glass 1 and extending up to the edge 7 of the transparent glass area, through which the watch dial appears. A rectangular transparent sapphire plate 8 is indissolubly glued to face 2 of glass 1.

Absolutely transparent glue producing an adhesion of several kilograms per square millimeter and withstanding all the chemical agents to which a watch may be exposed can be found on the market. Under these circumstances it will appear to those skilled in the art that either plate 8 or glass 1 will break before one will be able to separate them from one another.

Glue must, however, carefully be applied in order to form a thin absolutely close film free from air bubbles on the whole lower surface of plate 8, but without running over the edges thereof. The suitable glues are relatively fluid in latent state. Some of them set only under the action of ultra-violet light; other ones under the effect of heat at a predetermined temperature. Once plate 8 has been glued in that way to glass 1 no transparency difference can be observed with the naked eye between the glass area covered by plate 8 and the remaining glass portion.

To avoid damaging the clothes and to prevent plate 8 from jagging under the effect of impacts, this plate is bevelled as shown at 9.

FIG. 1 shows that indications 10, 11 appear through plate 8. One of them, 10, is constituted by the trademark of the watch manufacturer. This indication can be applied on face 6 of glass 1 by vaporization under vacuum at the same time as a deposit is formed on that face to opacify its periphery. Trade-mark 10 can just as well be applied in the same manner on face 2 of glass 1. Preferably, it will, however, be applied in the manner described on the reverse side of plate 8. In that way, the trade-mark 10 will always be perfectly centered on plate 8, even if the latter should not be glued at the exact position desired on glass 1.

Alone this mode of applying the trade-mark on a watch already offers to the general public a serious guarantee that the watch issues from the origin indicated thereon, because the equipment of most of the unlicensed factories, which make business by illicitly applying famous trade-marks on shoddy watches, does not permit either to work the sapphire both of glass 1 and plate 8 or to undertake vaporizations under vacuum. Moreover, the costs of those operations, which do not substantially increase the price of a fine watch, which is in any case provided with a bevelled sapphire glass, would be out of proportion to the price of the watches with fraudulently copied trade-marks, with which the market is flooded.

In addition to the trade-mark, the reverse side of plate 8 can receive further indications also serving to authentify the origin of the watch. Thus, indication 11 in FIG. 1, which may be composed of predetermined letters and figures, can constitute, in combination with the similar indication 12 engraved on bottom 13 of the watch casing (FIG. 3), a code individualizing every watch produced in a manner that cannot be copied. It suffices therefore to modify at least one of the indications 11, 12 from one watch to the other one. In that way, a determined pair of indications 11, 12 will appear only on a single one of the watches produced. By making a reference table of said pairs of indications for the licensed agencies, the latter can immediately determine whether the origin of a watch is genuine or not.

Vaporizing under vacuum permits to form very small letters and figures which are no longer readable with the naked eye. However, by means of a usual magnifying glass the purchaser can himself check whether the origin of a watch is genuine. It is, indeed, practically excluded that an unlicensed factory, producing cheap watches, invests the costs of the equipment required for forming so small letters and figures.

Figure 4:
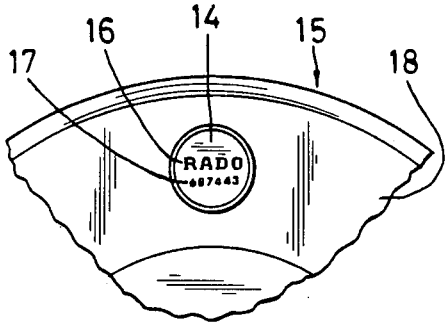
FIG. 4 is a partial plan view similar to FIG. 1, but of a piece of the second embodiment.
Figure 5:
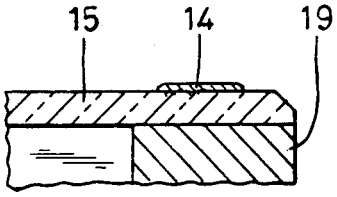
FIG. 5 is a part radial section of the second embodiment.

The application of the device according to the invention is not limited to rectangular watches. It can be used with the same advantages for instance with circular watches as shown by the second embodiment (FIGS. 4 and 5). In this case it is a circular plate 14 which is glued onto the circular glass 15 covering the whole upper face of the watch casing. Indications 16, 17 of the same nature as the indications 11, 12 of the first embodiment, are applied on the reverse side of plate 14. Preferably, the latter will be glued onto area 18 of glass 15, which is opacified by the ornamental elements 19 glued under the periphery of glass 15 (FIG. 5).

Figure 6:
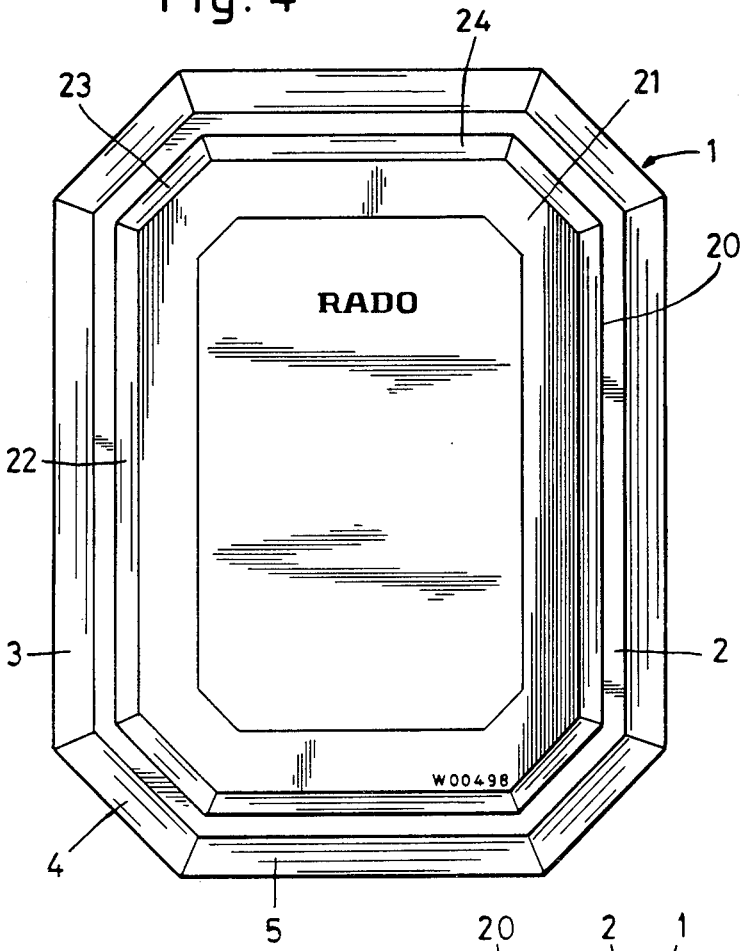
Figure 7:
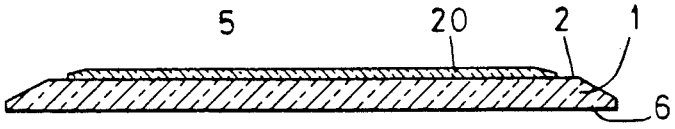
FIG. 7 is a cross-section.

The sizes of the plate glued onto the watch glass need not be reduced to those of the trade-mark and possibly of the coded indications. The third embodiment (FIGS. 6 and 7) shows a plate 20 having a shape analogous to that of the glass 1 and sizes only somewhat smaller than face 2 of the latter. Plate 20 thus extends over area 21 of glass 1, which is opacified by the ornamental elements (not shown) which face 6 of the glass carries at its periphery. With this embodiment, plate 20 not only throws the glass into relief, by providing the latter with well worked edges, but also enhances the appearance of the ornamental elements of glass area 21 due to the refractions produced by the bevels 22, 23, 24 of plate 20 that added themselves to those of bevels 3, 4, 5 of glass 1, while substantially increasing the yield and impact resistance of the glass. It will be observed that spreading glue without air bubbles and without running out on a plate as large as plate 20 is of a nature avoiding easy unlicensed copies.

The circular plate 25 of the fourth embodiment (FIGS. 8 and 9), which is glued onto the circular glass 15, shows that a large plate can also be used with a circular casing having its upper face entirely covered by the glass.

Figure 2:
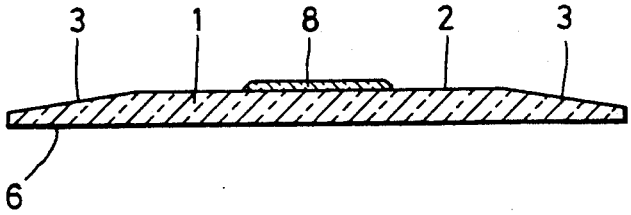
FIG. 2 is a transverse sectional view of the piece represented in FIG. 1.
Figure 3:
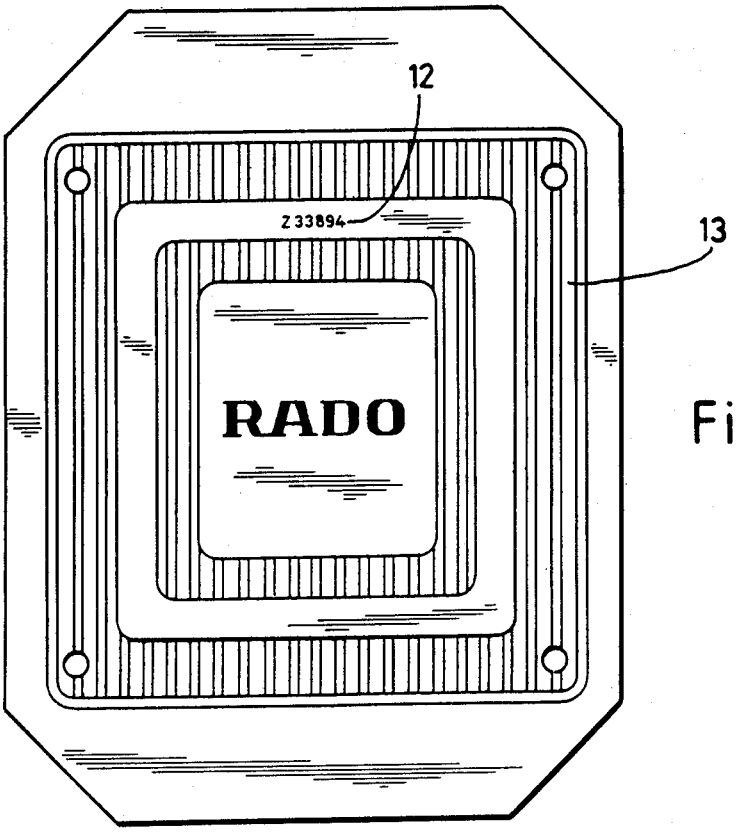
FIG. 3 is a view from the bottom side of the first embodiment.

The watch glass is not the only possible support for a protecting plate like those of the first four embodiments. With a casing having the periphery of glass 26 permanently glued onto the inner zone of a hard metal frame 27, as shown in FIG. 2 of my U.S. application Ser. No. 06/374689, plate 8 can be glued onto the part of frame 27 extending beyond glass 26 as shown in the fifth embodiment (FIGS. 10 and 11).

The sixth embodiment (FIGS. 12 and 13) shows that the same possibility exists for the circular plate 14, which is glued onto the hard metal ring 28 itself glued under glass 29.

Figure 16:
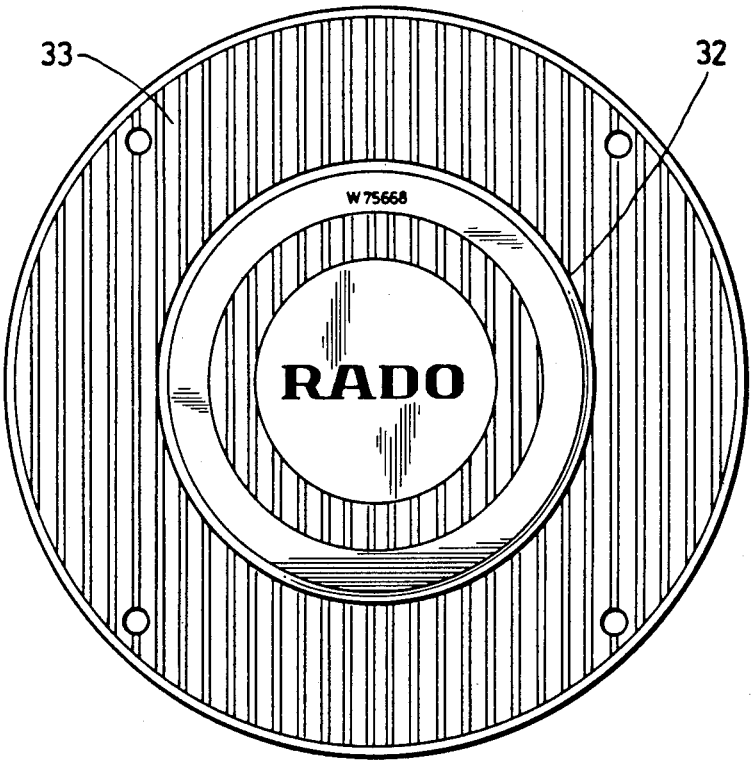
FIG. 16 is a view from the bottom side of the eighth embodiment.
Figure 17:
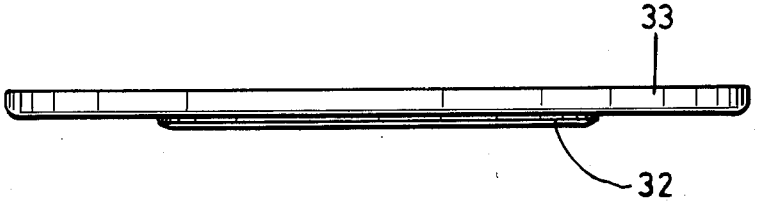
FIG. 17 is an elevational view of a part of FIG. 16.

The casing bottom can also serve as support for a plate like those disclosed hereabove. If it is rectangular, like bottom 30 of the seventh embodiment (FIGS. 14 and 15), the plate 31 glued thereonto will have a shape toning in with that of the bottom and one will similarly glue a circular plate 32 onto the bottom 33 of a circular casing (FIGS. 16 and 17).

With all the disclosed embodiments the reverse side of the protecting sapphire plate can obviously receive indications designating the origin of the watch such as the trade-mark and/or a coded indication which, in combination with a second indication, similarly coded, but different, and applied on another casing piece at a visible place, will form an identification code of the manufacturer or the distributor of the watches, while individualizing every one.

The protecting plates disclosed can also be glued on other materials as the sapphire of the glass, the hard metal of the frame or ring glued under the glass or the stainless steel of the casing bottom, for instance onto a gold-plated or chromium-plated bezel or bottom or on precious metals.

Although circular and rectangular protecting plates only have been disclosed, it will appear obvious to those skilled in the art that the device according to the invention can be applied to any other shape of casing such as a polygonal one with straight or curved edges. The shape of the protecting plate to be glued thereto can, indeed, always be harmonized to that of the casing.

I claim:

1. In a watch having a descriptive information that appears as applied on a piece being an integral part of its casing and constitutes at least a part of the indications designating the origin of the watch, a device for protecting said descriptive information, comprising a transparent plate of a scratchproof hard material, said plate being indissolubly glued onto said piece of the casing of the watch and extending above said descriptive information.

2. In a watch according to claim 1, said descriptive information being sandwiched between said plate and said piece of the watch casing, onto which said plate is glued.

3. In a watch according to claim 2, the face of said plate being glued to said piece of the watch casing carrying a coded information forming part of the indications designating the origin of the watch.

4. In a watch according to claim 3, said coded information being applied on said plate in sizes unreadable with the naked eye.

5. In a watch according to claim 2, said descriptive information including the trade-mark of the watch.

6. In a watch according to claim 1, said piece of the watch casing having a plane area and said plate being made of sapphire and glued onto said plane area.

7. In a watch according to claim 6, said piece of the watch casing consisting of the watch glass.

8. In a watch according to claim 6, its casing having a large bezel surrounding the watch glass, said plate being glued onto said bezel.

9. In a watch according to claim 6, said plate being glued onto the outer face of the bottom of the watch casing.

* * * * *